US011458350B2

(12) United States Patent
Yang

(10) Patent No.: US 11,458,350 B2
(45) Date of Patent: Oct. 4, 2022

(54) FAST-SWITCHING COMPREHENSIVE TRAINING DEVICE

(71) Applicant: YANGZHOU JIUYI HARDWARE & MACHINERY CO., LTD., Yangzhou (CN)

(72) Inventor: Yen-Shuo Yang, Taichung (TW)

(73) Assignee: YANGZHOU JIUYI HARDWARE & MACHINERY CO., LTD., Jiangsu (CN)

( * ) Notice: Subject to any disclaimer, the term of this patent is extended or adjusted under 35 U.S.C. 154(b) by 177 days.

(21) Appl. No.: 17/039,049

(22) Filed: Sep. 30, 2020

(65) Prior Publication Data

US 2022/0096891 A1 Mar. 31, 2022

(51) Int. Cl.
*A63B 21/00* (2006.01)
*A63B 21/078* (2006.01)
(Continued)

(52) U.S. Cl.
CPC ..... *A63B 21/156* (2013.01); *A63B 21/00065* (2013.01); *A63B 21/00069* (2013.01);
(Continued)

(58) Field of Classification Search
CPC ..... A63B 21/00065; A63B 21/00069; A63B 21/0428; A63B 21/0552; A63B 21/0628; A63B 21/078; A63B 21/156; A63B 21/00047; A63B 21/00058; A63B 21/00061; A63B 21/062; A63B 21/0622; A63B 21/0626; A63B 21/063; A63B 21/0632; A63B 21/15; A63B 21/151;
(Continued)

(56) References Cited

U.S. PATENT DOCUMENTS 6,447,430 B1 * 9/2002 Webb ..... A63B 21/154 482/93
7,651,443 B1 * 1/2010 Fenster ..... A63B 71/0036 482/37
(Continued)

FOREIGN PATENT DOCUMENTS

CN 104225876 B 7/2018
WO 02056973 A2 7/2002
(Continued)

OTHER PUBLICATIONS

Search Report issued to European counterpart application No. 20200035.2 by the EPO dated Mar. 15, 2021.

*Primary Examiner* — Megan Anderson

(57) ABSTRACT

A fast-switching comprehensive training device includes a main frame having two side frame portions; two cable and pulley assemblies symmetrically disposed on the side frame portions and each including an adjustment tube and a first sliding seat slidably sleeved on the adjustment tube; a barbell unit including two sliding guide rods respectively disposed on the side frame portions, two second sliding seats sleeved slidably and respectively on the sliding guide rods, and an exercise bar fixedly connected between the second sliding seats; two counterweight units disposed movably and respectively on the side frame portions; and two tension rope units each disposed between one of the side frame portions and a respective counterweight unit.

6 Claims, 18 Drawing Sheets

(51) Int. Cl.

| | |
|---|---|
| ***A63B 21/04*** | (2006.01) |
| ***A63B 21/062*** | (2006.01) |
| ***A63B 23/035*** | (2006.01) |
| *A63B 21/055* | (2006.01) |

(52) U.S. Cl.
CPC ..... *A63B 21/0428* (2013.01); *A63B 21/078* (2013.01); *A63B 23/03541* (2013.01); *A63B 23/03566* (2013.01); *A63B 21/0552* (2013.01); *A63B 21/0628* (2015.10); *A63B 21/151* (2013.01); *A63B 21/154* (2013.01)

(58) Field of Classification Search
CPC ... A63B 21/153; A63B 21/154; A63B 21/155; A63B 23/03541; A63B 23/03566
See application file for complete search history.

(56) References Cited

U.S. PATENT DOCUMENTS

| | | | | |
|---|---|---|---|---|
| 8,727,952 | B1 * | 5/2014 | Carle | A63B 21/0628 482/99 |
| 9,050,497 | B2 * | 6/2015 | Reyes | A63B 21/062 |
| 11,110,313 | B2 * | 9/2021 | Gore | A63B 21/0783 |
| 2002/0091043 | A1 * | 7/2002 | Rexach | A63B 21/0628 482/99 |
| 2013/0109543 | A1 * | 5/2013 | Reyes | A63B 21/4035 482/99 |
| 2020/0222745 | A1 * | 7/2020 | Leipheimer | A63B 21/4034 |

FOREIGN PATENT DOCUMENTS

| | | |
|---|---|---|
| WO | 2007061410 | 5/2007 |
| WO | 2018086028 A1 | 5/2018 |

* cited by examiner

FAST-SWITCHING COMPREHENSIVE TRAINING DEVICE

FIELD

The disclosure relates to a fitness equipment, more particularly to a fast-switching comprehensive training device for fitness.

BACKGROUND

With the increasing standard of living, people are increasingly paying attention to their posture and health. As a result, more and more fitness equipments entered people's lives. A popular strength fitness equipment on the market has a single function, for example, a cable machine or a Smith machine, is expensive, has a large volume so that it occupies a large space, and is heavy.

A retractable Smith machine, as disclosed in Chinese Patent No. CN207898846U, has both ends of a barbell extending out of a frame thereof to increase the counterweight. However, the counterweight cannot be increased or decreased in a quick and convenient manner.

SUMMARY

Therefore, an object of the present disclosure is to provide a fast-switching comprehensive training device that is capable of alleviating at least one of the drawbacks of the prior art.

According to this disclosure, a fast-switching comprehensive training device comprises a main frame, two cable and pulley assemblies, a barbell unit, two counterweight units and two tension rope units. The main frame includes a middle portion, two side frame portions connected to two opposite ends of the middle portion, two pairs of counterweight guide rods respectively disposed on the side frame portions, and two pairs of cushion pads respectively disposed on bottom portions of the pairs of the counterweight guide rods. Each side frame portion includes a bottom rod, a top rod opposite to the bottom rod, and at least one vertical rod connected between the bottom rod and the top rod and spaced apart from and parallel to a corresponding one pair of the counterweight guide rods. The at least one vertical rod has a plurality of hanging holes spaced apart from each other along a length thereof.

The cable and pulley assemblies are symmetrically disposed on the side frame portions. Each cable and pulley assembly includes an adjustment tube connected between the bottom rod and the top rod and spaced apart from and parallel to the at least one vertical rod, a first sliding seat slidably sleeved on the adjustment tube, an adjustment pin removably inserted into the first sliding seat, two spaced-apart first upper pulleys mounted on the top rod, two second upper pulleys disposed below the first upper pulleys, two lower pulleys mounted on the bottom rod, and a cable member having a first end, a second end opposite to the first end, and an intermediate section connected between the first end and the second end. The adjustment tube has a plurality of height adjustment holes spaced apart from each other along a length thereof.

The barbell unit includes two sliding guide rods respectively disposed on the side frame portions, two second sliding seats sleeved slidably and respectively on the sliding guide rods, an exercise bar having two opposite ends connected fixedly and respectively to the second sliding seats, and two hook members rotatably disposed on the exercise bar in proximity to the two opposite ends thereof. Each sliding guide rod is connected between the bottom rod and the top rod of a respective one of the side frame portions, and is located between the at least one vertical rod and the adjustment tube. Each hook member is removably hooked to a selected one of the hanging holes in the at least one vertical rod of the respective side frame portion so as to position each second sliding seat relative to the at least one vertical rod of the respective side frame portion and a corresponding one of the sliding guide rods.

The counterweight units are respectively disposed on the side frame portions and are respectively movable along the pairs of counterweight guide rods. Each counterweight unit includes a pulley bracket disposed on top thereof, and a counterweight pulley pivotally connected to the pulley bracket. Each tension rope unit includes a plurality of tension ropes.

When the adjustment pin is inserted into the first sliding seat and extends into a corresponding one of the height adjustment holes, the first sliding seat is fixed to the adjustment tube at a desired height.

The first end of the cable member is movable between a first position, in which the first end of the cable member is positioned on the first sliding seat to place the fast-switching comprehensive training device in a first exercise mode, and a second position, in which the first end of the cable member is positioned on the second sliding seat to place the fast-switching comprehensive training device in a second exercise mode.

The second end of the cable member is positioned on the first sliding seat opposite to the first end, and the intermediate section of the cable member is looped around the lower pulleys, the second upper pulleys, the counterweight pulley and the first upper pulleys.

Each tension rope has one end hooked to the bottom rod, and the other end removably hooked to a corresponding one of the counterweight units.

BRIEF DESCRIPTION OF THE DRAWINGS

Other features and advantages of the disclosure will become apparent in the following detailed description of the embodiments with reference to the accompanying drawings, in which.

DETAILED DESCRIPTION

Figure 1:
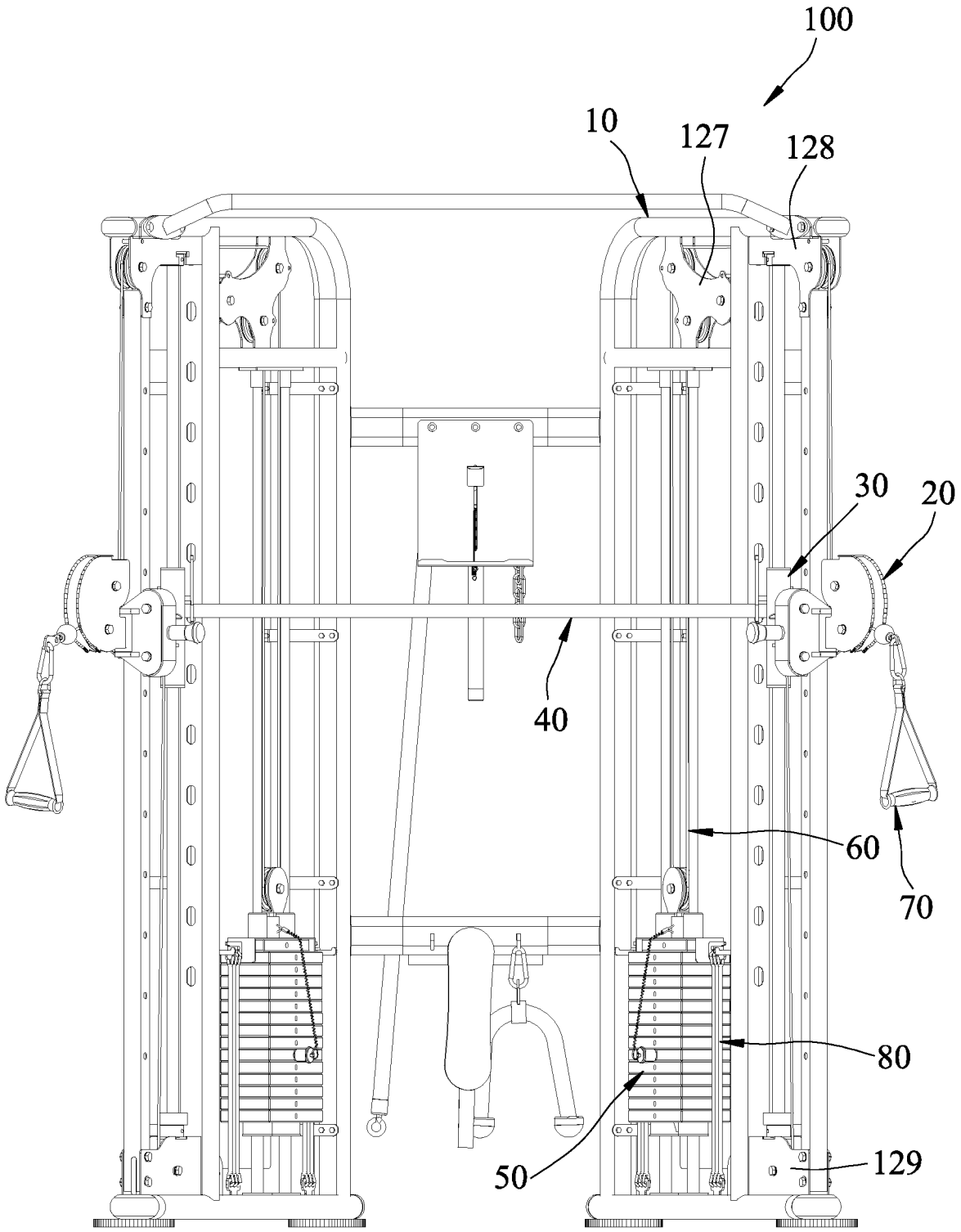
FIG. 1 is a schematic front view of a fast-switching comprehensive training device according to the first embodiment of the present disclosure.

Before the present disclosure is described in greater detail with reference to the accompanying embodiments, it should be noted herein that like elements are denoted by the same reference numerals throughout the disclosure.

Figure 2:
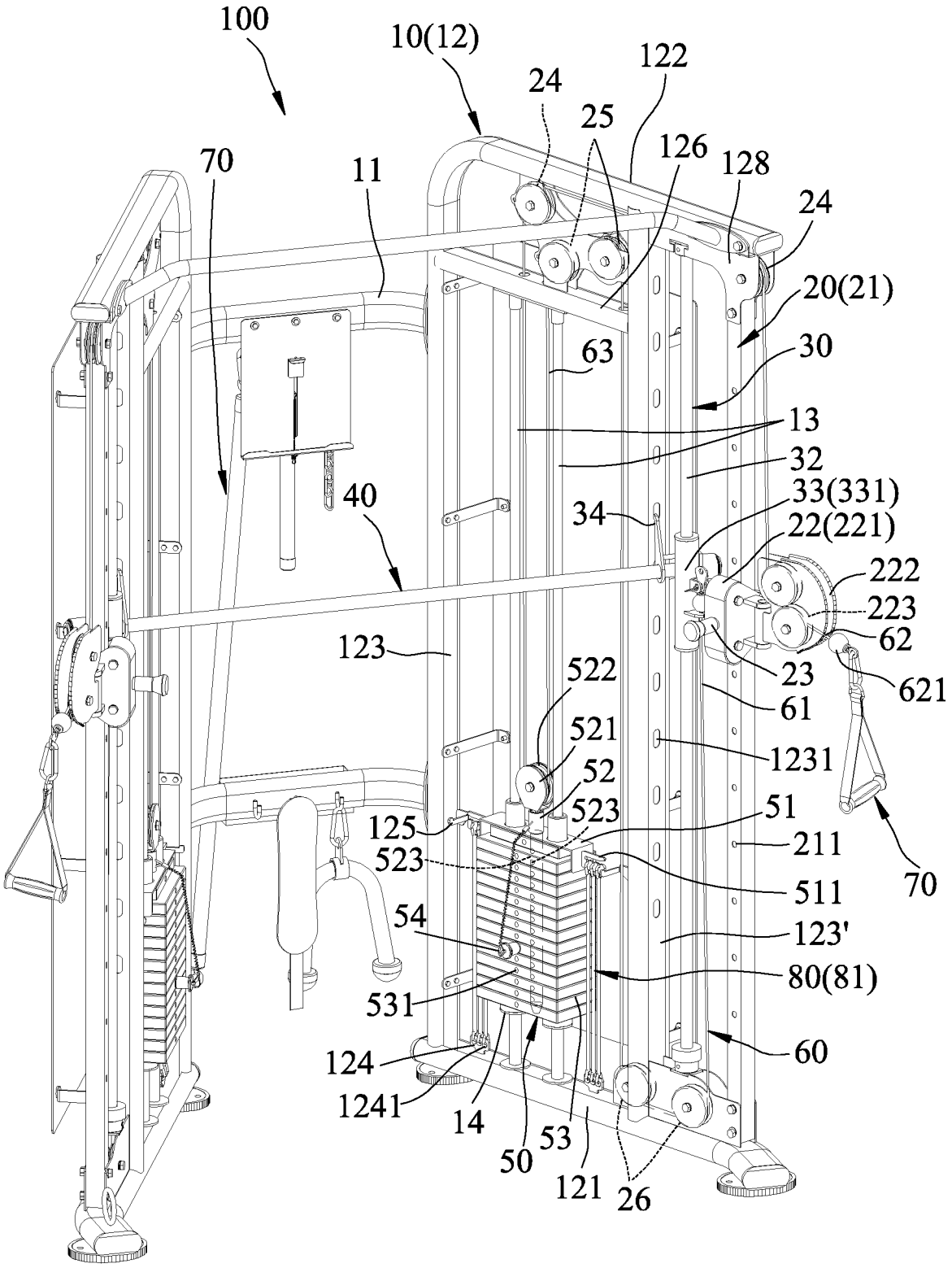
FIG. 2 is a perspective view of the first embodiment.
Figure 3:
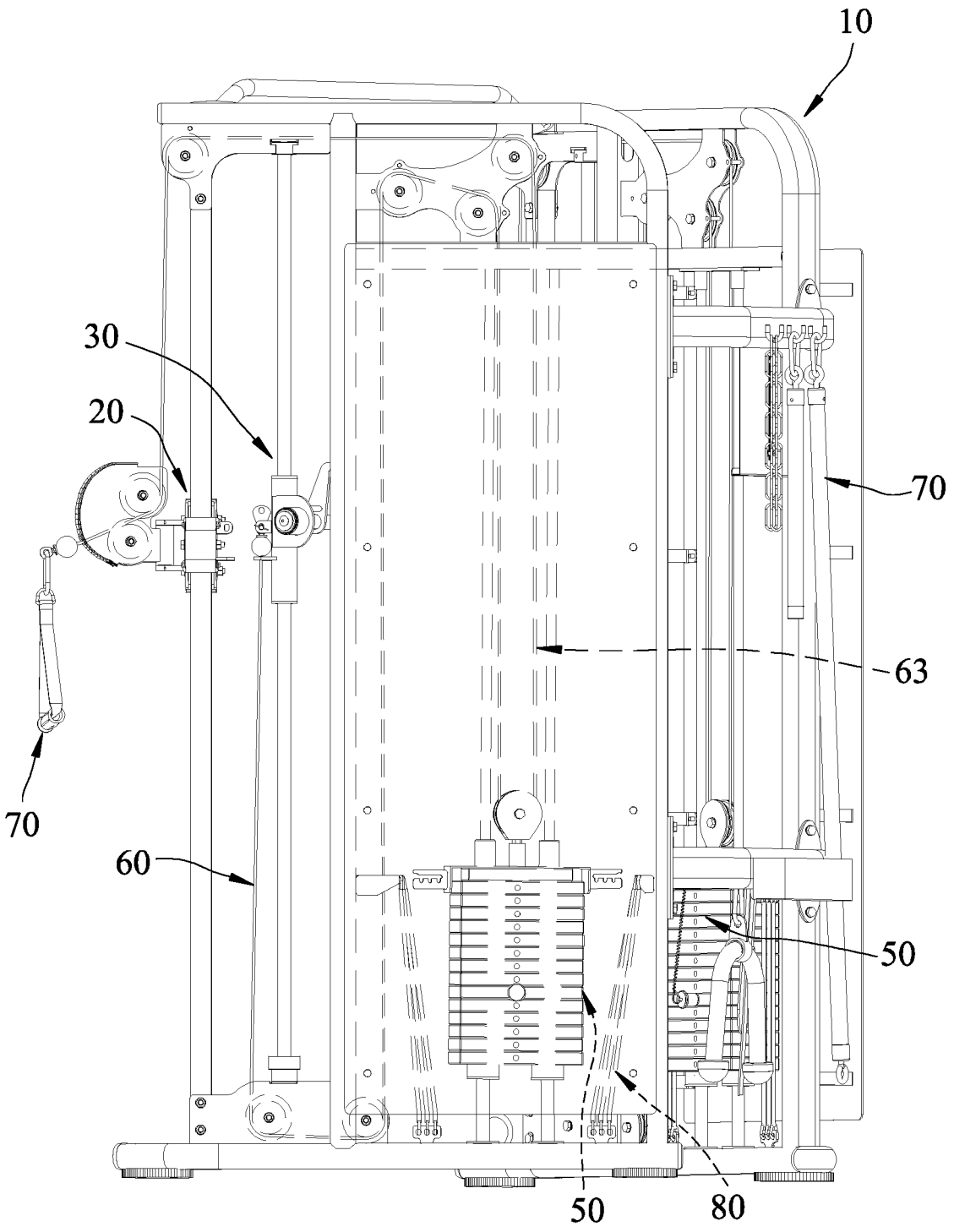
FIG. 3 is a schematic side view of the first embodiment.

Referring to FIGS. 1 to 3, a fast-switching comprehensive training device 100 according to the first embodiment of the present disclosure is shown to comprise a main frame 10, two cable and pulley assemblies 20, a barbell unit 30, two counterweight units 50, a plurality of handles or handgrips 70, and two tension rope units 80.

The main frame 10 includes a middle portion 11, two side frame portions 12 connected to two opposite ends of the middle portion 11 and cooperating with the middle portion 11 to form a U-shaped frame body, two pairs of counterweight guide rods 13 respectively disposed on the side frame portions 12, and two pairs of cushion pads 14 respectively disposed on bottom portions of the pairs of counterweight guide rods 13. Each side frame portion 12 includes a bottom rod 121, a top rod 122 opposite to the bottom rod 121, a vertical rod 123 connected between the bottom and top rods 121, 122 at inner ends thereof, a vertical rod 123' connected between the bottom and top rods 121, 122 in proximity to outer ends thereof, two spaced-apart fixed plates 124 disposed on the bottom rod 121, two storage hooks 125 respectively connected to the vertical rods 123, 123' and located between the bottom and top rods 121, 122, a cross rod 126 connected between the vertical rods 123, 123' and located adjacent to and spaced apart from the top rod 122, a pair of first upper pulley brackets 127 having three sides respectively connected to the top rod 122, the cross rod 126 and the vertical rod 123', a pair of second upper pulley brackets 128 connected to the top rod 122 and located between the outer end of the top rod 122 and the vertical rod 123', and a pair of lower pulley brackets 129 connected to the bottom rod 121.

Each pair of counterweight guide rods 13 is connected between the bottom rod 121 and the cross rod 126 and is located between the vertical rods 123, 123'. The vertical rod 123' is formed with a plurality of hanging holes 1231 spaced apart from each other along a length thereof. Each fixed plate 124 is located between one of the vertical rods 123, 123' and a corresponding one of the pair of counterweight guide rods 13, and is formed with a plurality of fixing holes 1241. The storage hooks 125 are respectively proximate to the fixed plates 124. The lower pulley brackets 129 have major portions located between the outer end of the bottom rod 121 and the vertical rod 123', and minor portions extending through the vertical rod 123'.

The cable and pulley assemblies 20 are symmetrically disposed on the side frame portions 12. Each cable and pulley assembly 20 includes an adjustment tube 21 connected between the pair of lower pulley brackets 129 and the pair of second upper pulley brackets 128 of a respective one of the side frame portions 12 and spaced apart from and parallel to the vertical rod 123', a first sliding seat 22 slidably sleeved on the adjustment tube 21, an adjustment pin 23 removably inserted into the first sliding seat 22, two first upper pulleys 24, two second upper pulleys 25, two lower pulleys 26, a cable member 60, and a retaining unit. The adjustment tube 21 has a plurality of height adjustment holes 211 spaced apart from each other along a length thereof. One of the first upper pulleys 24 is pivotally connected to the pair of first upper pulley brackets 127 at one side thereof that is connected to the top rod 122, while the other first upper pulley 24 is pivotally connected to the pair of second upper pulley brackets 128. The second upper pulleys 25 are pivotally connected to the pair of first upper pulley brackets 127 at the other two sides thereof that are respectively connected to the cross rod 126 and the vertical rod 123'. The lower pulleys 26 are pivotally connected to the pair of lower pulley brackets 129.

Figure 4:
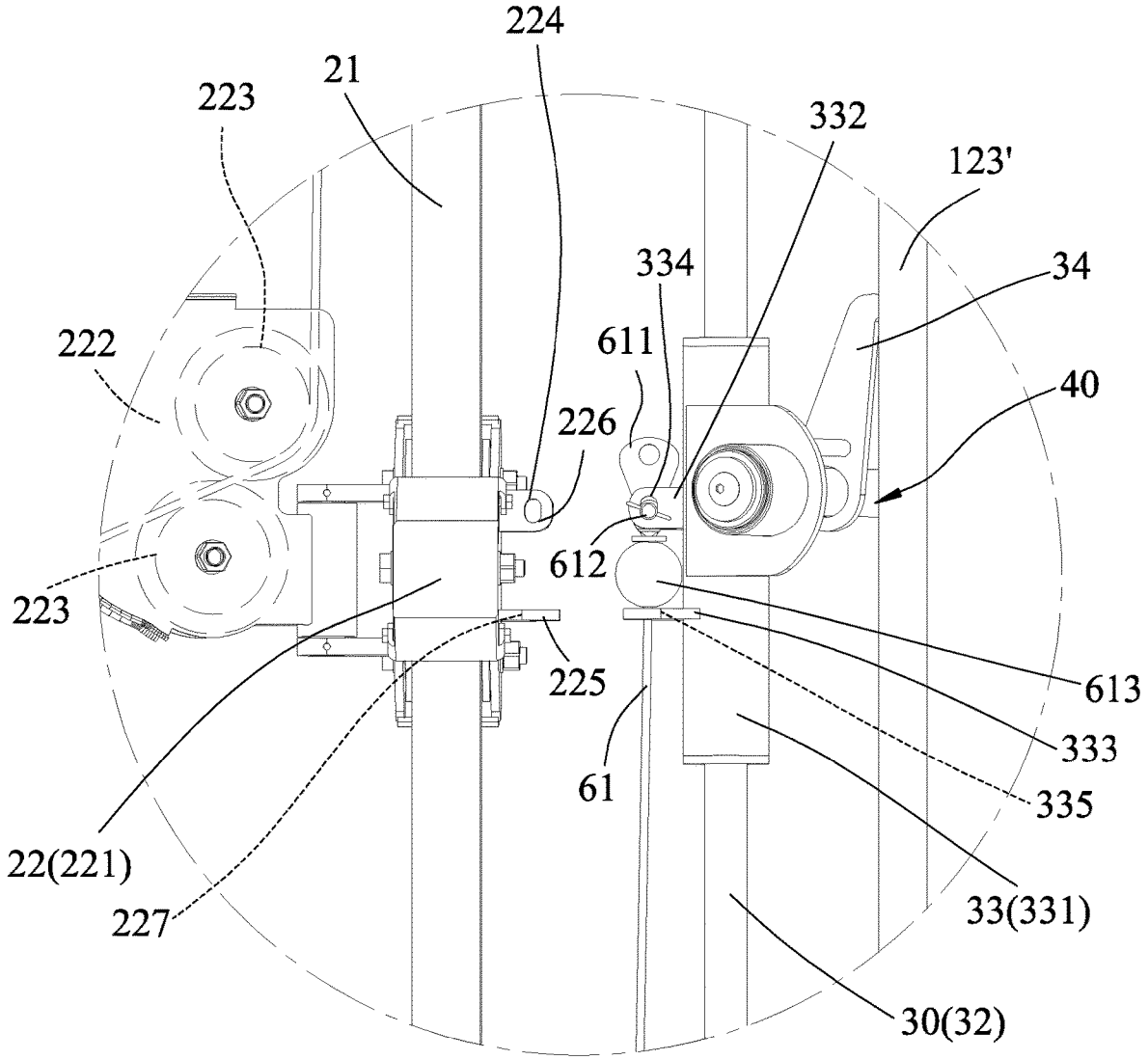
FIG. 4 is an enlarged view of an encircled portion A of FIG. 3.
Figure 5:
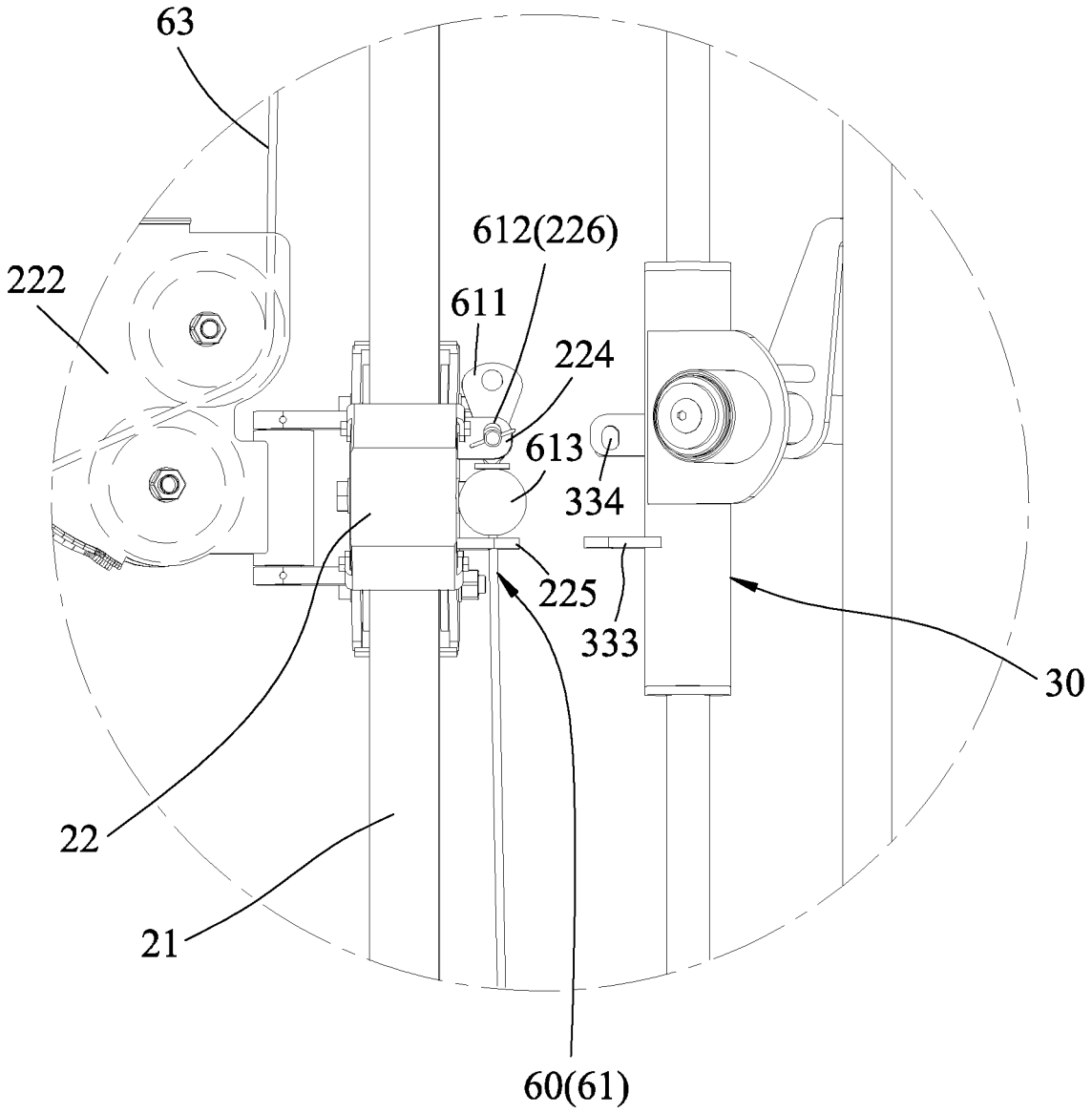
FIG. 5 is a view similar to FIG. 4, but with a first end of a cable member being positioned on a first sliding seat.

Referring to FIGS. 4 and 5, in combination with FIGS. 1 to 3, the first sliding seat 22 includes a first sliding seat body 221 slidably sleeved on the adjustment tube 21, a pivoting member 222 connected to one side of the first sliding seat body 221, a pair of pulleys 223 pivotally connected to and disposed side by side in the pivoting member 222, a U-shaped first fixing member 224 connected to the other side of the first sliding seat body 221 and opposite to the pivoting member 222, and a first positioning plate 225 connected to the first sliding seat body 221 and located below the first fixing member 224. The first fixing member 224 has a pair of first pin holes 226. The first positioning plate 225 has a first positioning hole 227 defined by a C-shaped wall and tapering inwardly from a top surface of the first positioning plate 225. When the adjustment pin 23 is inserted into the first sliding seat body 221 and extends into a corresponding one of the height adjustment holes 211, the first sliding seat 22 is fixed to the adjustment tube 21 at a desired height.

The cable member 60 has a first end 61, a second end 62 opposite to the first end 61, and an intermediate section 63 connected between the first and second ends 61, 62. The retaining unit includes a retaining ball 613 connected to the first end 61, a fastening piece 611 fixed on top of the retaining ball 613, and an insert pin 612. The intermediate section 63 is looped around the lower pulleys 26, the second upper pulleys 25, a counterweight pulley 522 of the counterweight unit 50, and the first upper pulleys 24. The second end 62 passes between the pair of pulleys 223, and is connected with a retaining ball 621 to retain externally of the pivoting member 222 for connection with one of the handles 70.

The barbell unit 30 includes two sliding guide rods 32, two second sliding seats 33, an exercise bar 40 and two hook members 34. Each sliding guide rod 32 is connected between the pair of second upper pulley brackets 128 and the pair of lower pulley brackets 129, and is parallel to and located between the vertical rod 123' and the adjustment tube 21.

Each second sliding seat 33 includes a second sliding seat body 331 sleeved slidably on a respective one of the sliding guide rods 32, a U-shaped second fixing member 332 fixed to one side of the second sliding seat body 331 that is proximate to the adjustment tube 21, and a second positioning plate 333 connected to the second sliding seat body 331 and located below the second fixing member 332. The second fixing member 333 has a pair of second pin holes 334. The second positioning plate 333 has a second positioning hole 335 defined by a C-shaped wall and tapering inwardly from a top surface of the second positioning plate 335. The one side of the first sliding seat body 221 is distal to a corresponding one of the sliding guide rods 32. That is, the pivoting member 222 is located distal to the corresponding sliding guide rod 32.

The first end 61 of the cable member 60 is movable between a first position and a second position. In the first position, as shown in FIG. 5, the first end 61 of the cable member 60 is positioned on the first sliding seat 22 to place the comprehensive training device 100 in a first exercise mode, in which various cable machine exercises may be performed. In the second position, as shown in FIG. 4, the first end 61 of the cable member 60 is positioned on the second sliding seat 33 to place the comprehensive training device 100 in a second exercise mode, in which various Smith machine exercises may be performed.

The insert pin 612 of the retaining unit is configured for positioning the first end 61 of the cable member 60 in the first position or the second position.

Specifically, the insert pin 612 is removably inserted into the pair of first pin holes 226 and a hole in the fastening piece 611 to position the first end 61 of the cable member 60 at the first position, and is removably inserted into the pair of second pin holes 334 and the hole in the fastening piece 611 to position the first end 61 of the cable member 60 at the second position. The retaining ball 613 abuts against the first positioning plate 225 when the first end 61 of the cable member 60 is at the first position, and abuts against the second positioning plate 333 when the first end 61 of the cable member 60 is at the second position.

The exercise bar 40 has two opposite ends connected fixedly and respectively to the second sliding seat bodies 331 of the second sliding seats 33. The hook members 34 are rotatably disposed on the exercise bar 40 in proximity to the two opposite ends thereof. Each hook member 34 is removably hooked to a selected one of the hanging holes 311 in the vertical rod 123' of the respective side frame portion 12 so as to position each second sliding seat 33 relative to the vertical rod 123' of the respective side frame portion 12 and a corresponding one of the sliding guide rods 32.

The counterweight units 50 are respectively disposed on the side frame portions 12, and are respectively movable along the pairs of counterweight guide rods 13. Each counterweight unit 50 includes a tension rope selection rack 51 sleeved on a corresponding one pair of the counterweight guide rods 13, a selection rod 52 inserted into the tension rope selection rack 51 at a central portion thereof and transverse to the bottom rod 121 and the top rod 122, a plurality of counterweights 53 sleeved on the selection rod 52 and the corresponding one pair of the counterweight guide rods 13, and a selection pin 54. The tension rope selection rack 51 has a pair of hangers 511 located at two opposite sides thereof which respectively face the vertical rods 123, 123'. The selection rod 52 has a plurality of insertion holes 523 spaced apart from each other along a length thereof, and a pulley bracket 521 disposed on top thereof. The counterweight pulley 522 is pivotally connected to the pulley bracket 521. Each counterweight 53 has a rectangular shape, and is formed with a through hole 531 at a central portion thereof and extending in a width direction thereof. The selection pin 54 is removably inserted into the through hole 531 of a selected one of the counterweights 53 and a corresponding one of the insertion holes 523 in the selection rod 52.

The handles or handgrips 70 are removably and selectively connected to the second ends 62 of the cable members 60, and may include two triangular handgrips, a short grip bar, a U-shaped handgrip, a long grip bar, etc.

Each tension rope unit 80 includes a plurality of tension ropes 81 equally disposed on the two opposite sides of the tension rope selection rack 51. Each tension rope 81 has one end hooked to one of the fixing holes 1241 in a corresponding one of the fixing plates 124, and the other end which may be selectively hooked to one of the hangers 511 or one of the storage hooks 125. That is, during exercise, the other end of each tension rope 81 is hooked to one of the hangers 511 so that each tension rope 81 can provide an elastic resistance. Because each user needs different elastic resistance, the number of the tension ropes 81 hooked to the hangers 511 may be adjusted. The other ends of the tension ropes 81 that are not needed may be hooked to the corresponding storage hooks 125.

With reference to FIGS. 1 and 2, when the adjustment pin 23 of each cable and pulley assembly 20 is pulled out from the first sliding seat 22 of the respective cable and pulley assembly 20, the height of the first sliding seat 22 relative to the adjustment tube 21 can be adjusted by sliding the first sliding seat 22 along the length of the adjustment tube 21. After a desired height of the first sliding seat 22 relative to the adjustment tube 21 is reached, the adjustment pin 23 is then inserted into the first sliding seat 22 and the corresponding height adjustment hole 211 to fix the first sliding seat 22 to the adjustment tube 21. Hence, since the height of the first sliding seat 22 of each cable and pulley assembly 20 can be adjusted, a prestressed force provided by each tension rope unit 80 to the cable member 60 of each cable and pulley assembly 20 can also be adjusted.

Further, when a user pulls the handles 70, through the intermediate section 63 of the cable member 60 of each cable and pulley assembly 20 that loops around the counterweight pulley 522 of the corresponding counterweight unit 50, each counterweight unit 50 can be moved, and through the weight of each counterweight unit 50 and the elasticity of each tension rope unit 80, the first exercise mode can be performed. At this time, the barbell unit 30 is not connected to the counterweight units 50.

With reference to FIGS. 2 and 4, when the first end 61 of the cable member 60 is positioned on the second positioning plate 333 through the retaining ball 613 and through the insertion of the insert pin 612 into the pair of second pin holes 334 of the second fixing member 332 and the hole in the fastening piece 611, the second end 62 of the cable member 60 is retained externally of the pivoting member 222 through the retaining ball 621, and the intermediate section 63 of the cable member 60 is looped around the lower pulleys 26, the second upper pulleys 25, the counterweight pulley 522 and the first upper pulleys 24. Through this, the first sliding seat 22, the first end 61 of the cable member 60, the lower pulleys 26, the second upper pulleys 25, the counterweight pulley 522, the first upper pulleys 24, and the second end 62 of the cable member 60 disposed on each side frame portion 12 form a loop.

When the height of each second sliding seat 33 relative to the respective sliding guide rod 32 is adjusted, and each hook member 34 is hooked to a selected one of the hanging holes 1231, each second sliding seat 33 can be fixed to the respective sliding guide rod 32 at a desired height. Since the height of each second sliding seat 33 can be adjusted, the prestressed force provided by each tension rope unit 80 to the cable member 60 of the respective cable and pulley assembly 20 can also be adjusted.

When each hook member 34 is removed from the selected one of the hanging holes 1231, and the user pulls the exercise bar 40, through the intermediate section 63 of the cable member 60 of each cable and pulley assembly 20 that loops around the counterweight pulley 522 of the corresponding counterweight unit 50, each counterweight unit 50 can be moved, and through the weight of each counterweight unit 50 and the elasticity of each tension rope unit 80, the second exercise mode can be performed. At this time, since the length of the cable member 60 of each cable and pulley assembly 20 is fixed, it is not advisable to use the cable and pulley assemblies 20.

Therefore, through the configurations of the cable and pulley assemblies 20 and the barbell unit 30, and with the first end 61 of the cable member 60 of each cable and pulley assembly 20 being able to be moved and positioned on the first fixing member 224 or the second fixing member 332, the comprehensive training device 100 of this disclosure can be quickly switched between the first exercise mode and the second exercise mode. To switch between the exercise modes, it is only necessary to pull out the insert pin 612 from one of the pair of first pin holes 226 and the pair of second pin holes 334 and then insert it to the other one of the pair of first pin holes 226 and the pair of second pin holes 334. By combining two devices into one, this disclosure has a reduced cost, and does not occupy a substantial area.

Furthermore, according to the needs of the user, the selection pin 54 can be inserted into the through hole 531 of a selected one of the counterweights 513 and a corresponding one of the insertion holes 523 in the selection rod 52, and the number of the tension ropes 81 can be selected by hooking each tension rope 81 between one of the hangers 511 and one of the fixing holes 1241 in the corresponding fixed plate 124.

Figure 6:
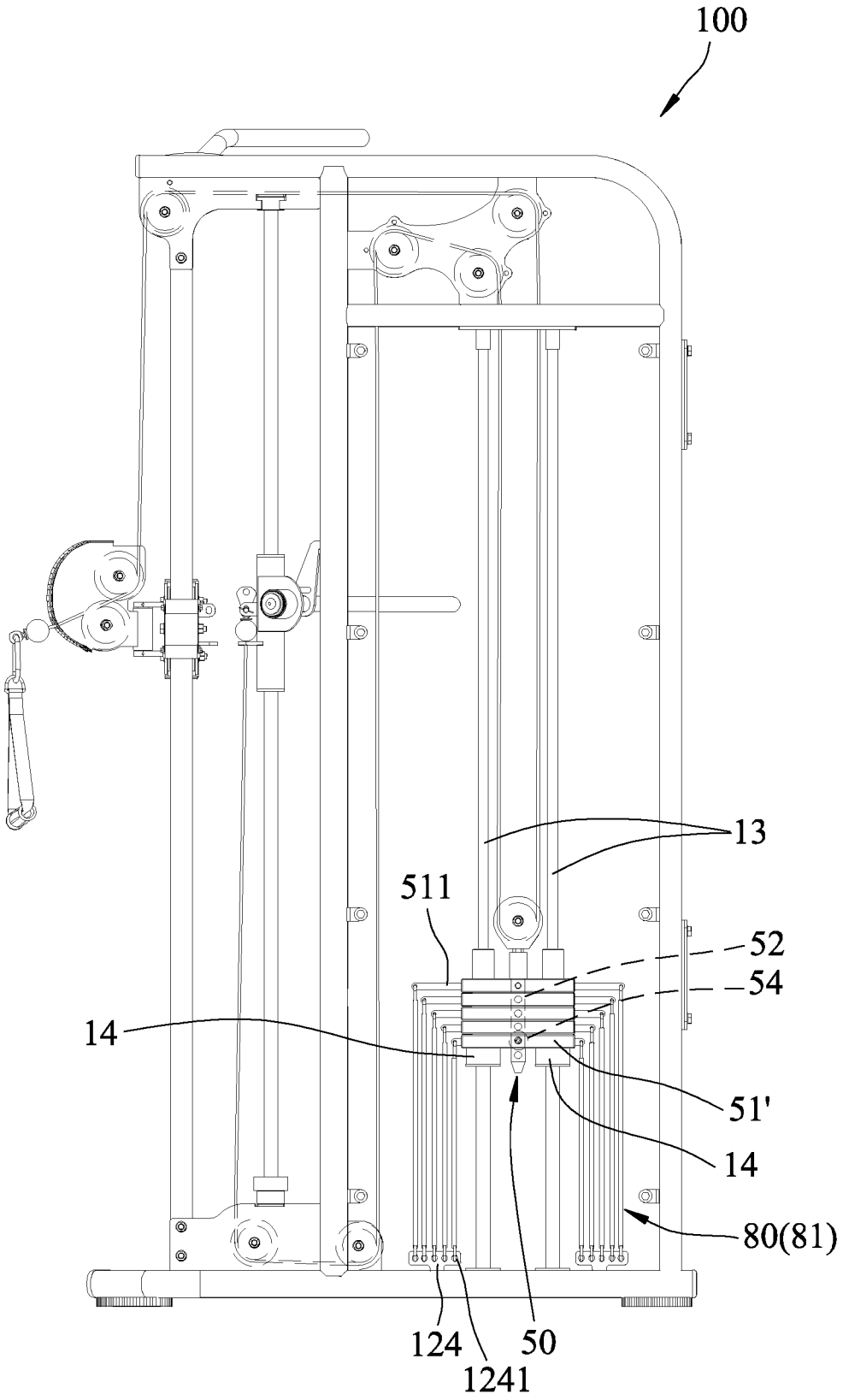
FIG. 6 is a schematic side view of a fast-switching comprehensive training device according to the second embodiment of the present disclosure.

Referring to FIG. 6, the second embodiment of the fast-switching comprehensive training device 100 of this disclosure differs from the first embodiment in that each counterweight unit 50' includes a plurality of the tension rope selection racks 51' sleeved on the selection rod 52 and the pair of counterweight guide rods 13, and the selection pin 54 is removably inserted into a selected one of the tension rope selection racks 51' and a corresponding one of the insertion holes 523 (see FIG. 2) in the selection rod 52. The counterweights 53 (see FIGS. 1 and 2) are not provided in this embodiment. Each tension rope selection rack 51' is similarly provided with a pair of hangers 511 at the two opposite sides thereof. Each tension rope 81 of the tension rope unit 80 has the one end hooked to one of the fixing holes 1241 in a corresponding one of the fixed plates 124, and the other end hooked to one of the hangers 511 of a corresponding one of the tension rope selection racks 51'. Each pair of counterweight guide rods 13 is fixedly connected with a pair of cushion pads 14. The second embodiment can achieve the same operation purpose and fitness effect as the first embodiment.

Figure 7:
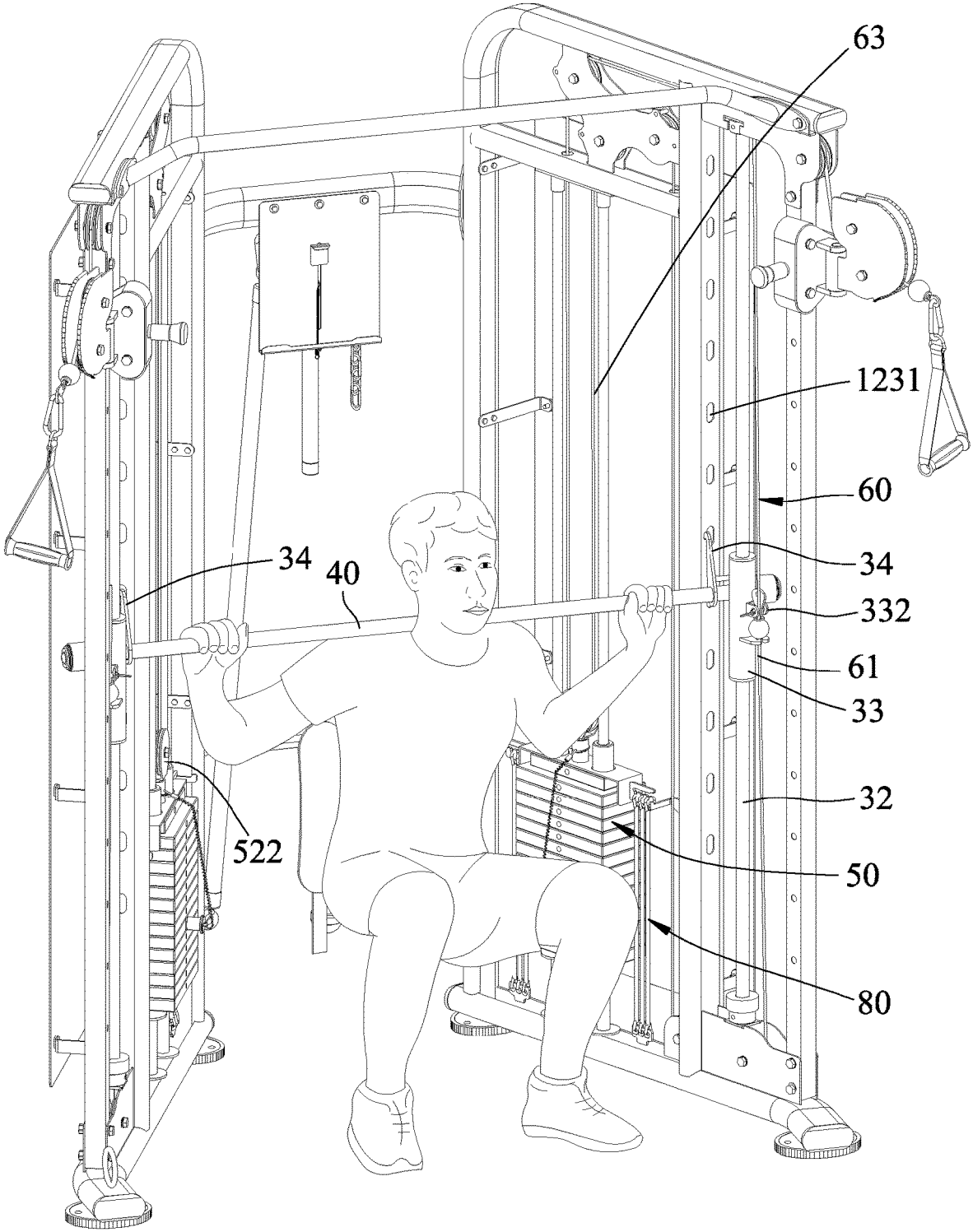
FIGS. 7 to 18 depict different exercises that can be performed using the fast-switching comprehensive training device of this disclosure.
Figure 8:
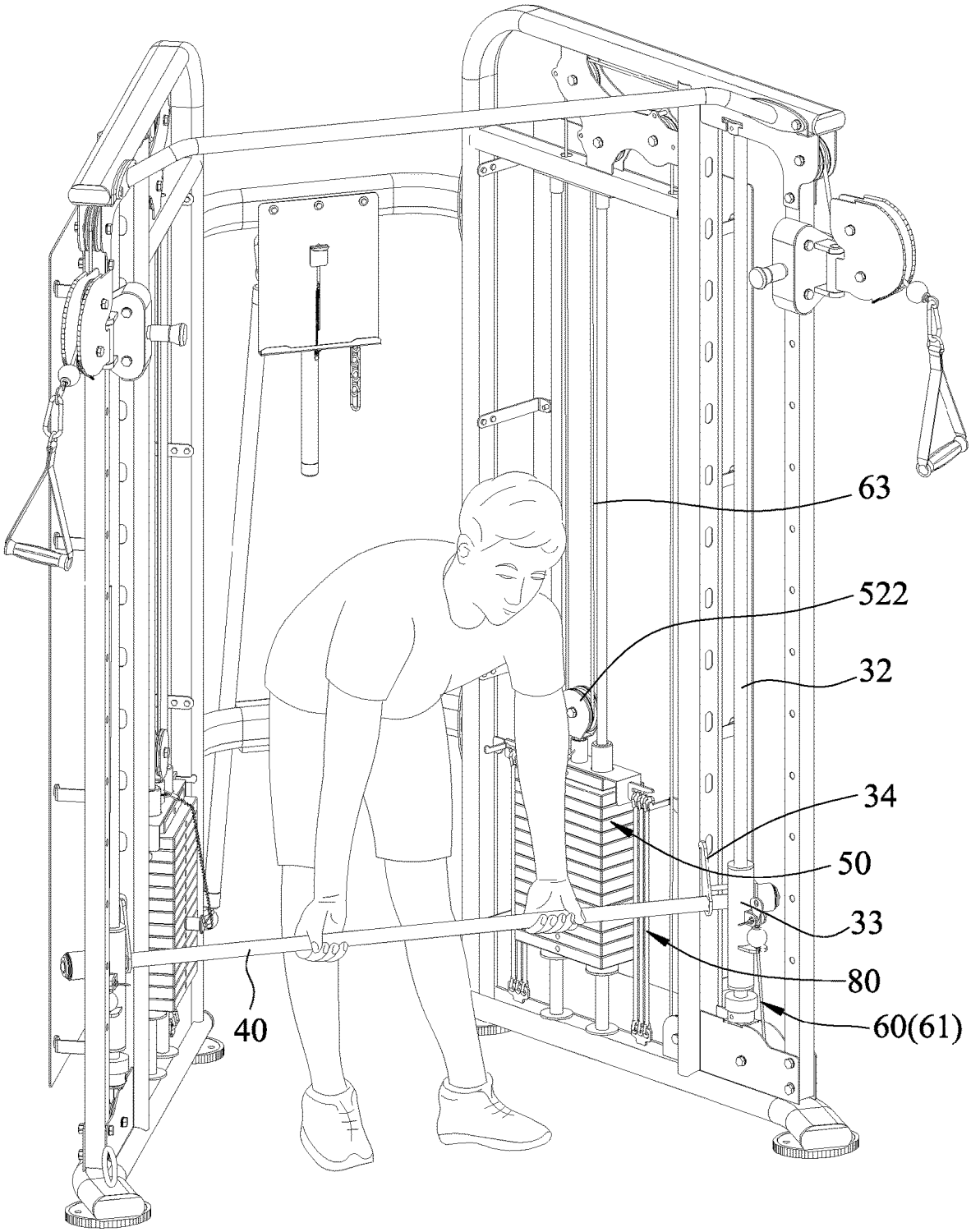

The operation of this disclosure is described below. Referring to FIGS. 7 and 8, in combination with FIG. 4, when the first end 61 of the cable member 60 of each cable and pulley assembly 20 is positioned on the second fixing member 332 of the corresponding second sliding seat 33, and each hook member 34 is removed from the corresponding hanging hole 1231, the user can perform a squat exercise, as shown in FIG. 7, and a dead lift exercise, as shown in FIG. 8. During use, each second sliding seat 33 is slidable along the length of the respective sliding guide rod 32, and with the middle section 63 of the cable member 63 of each cable and pulley assembly 20 looping around the respective counterweight pulley 522 so that each counterweight unit 50 can be moved, and through the weight of each counterweight unit 50 and the elasticity of each tension rope unit 80, the Smith machine exercises can be performed by the user.

Figure 9:
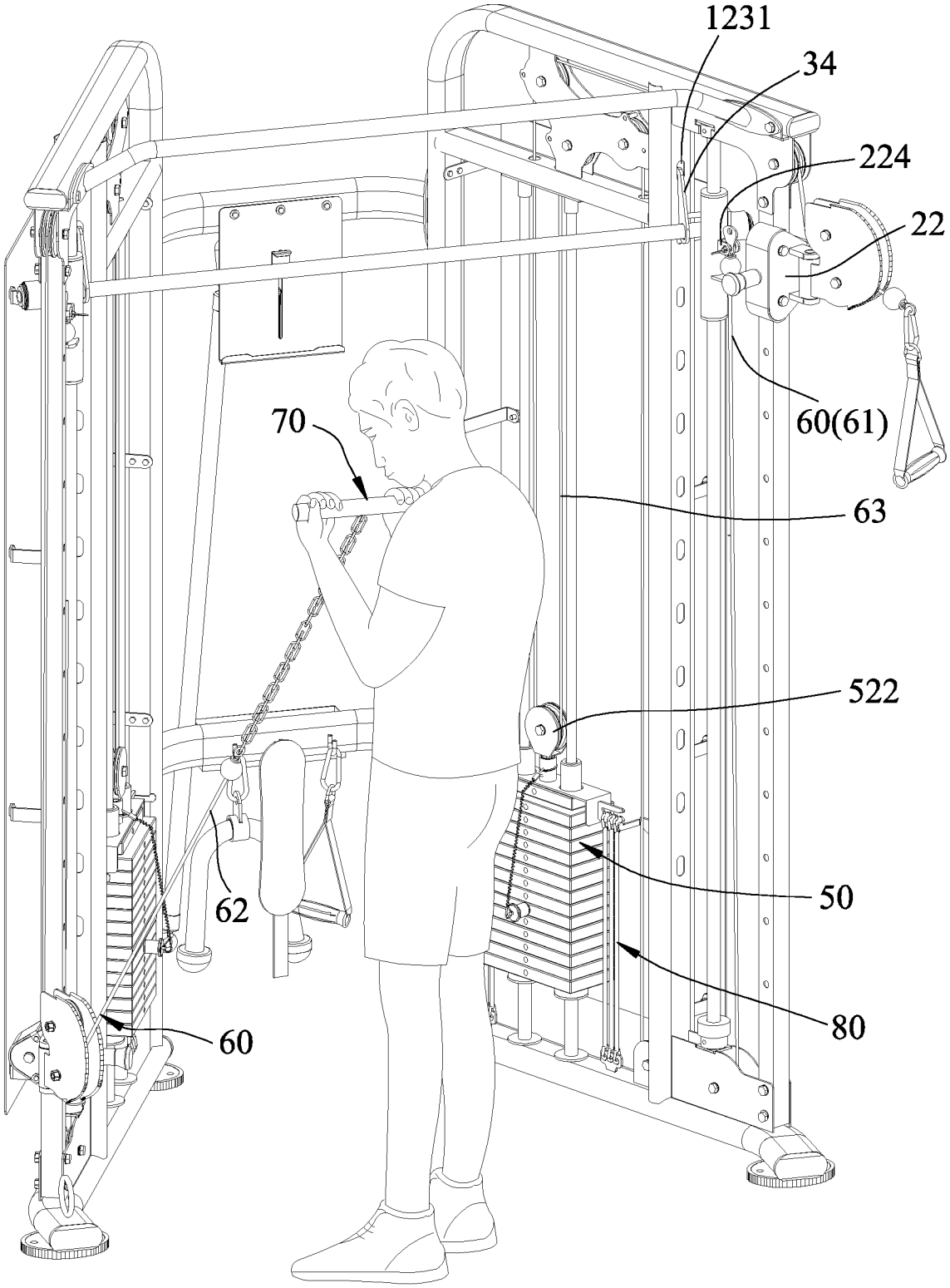
Figure 10:
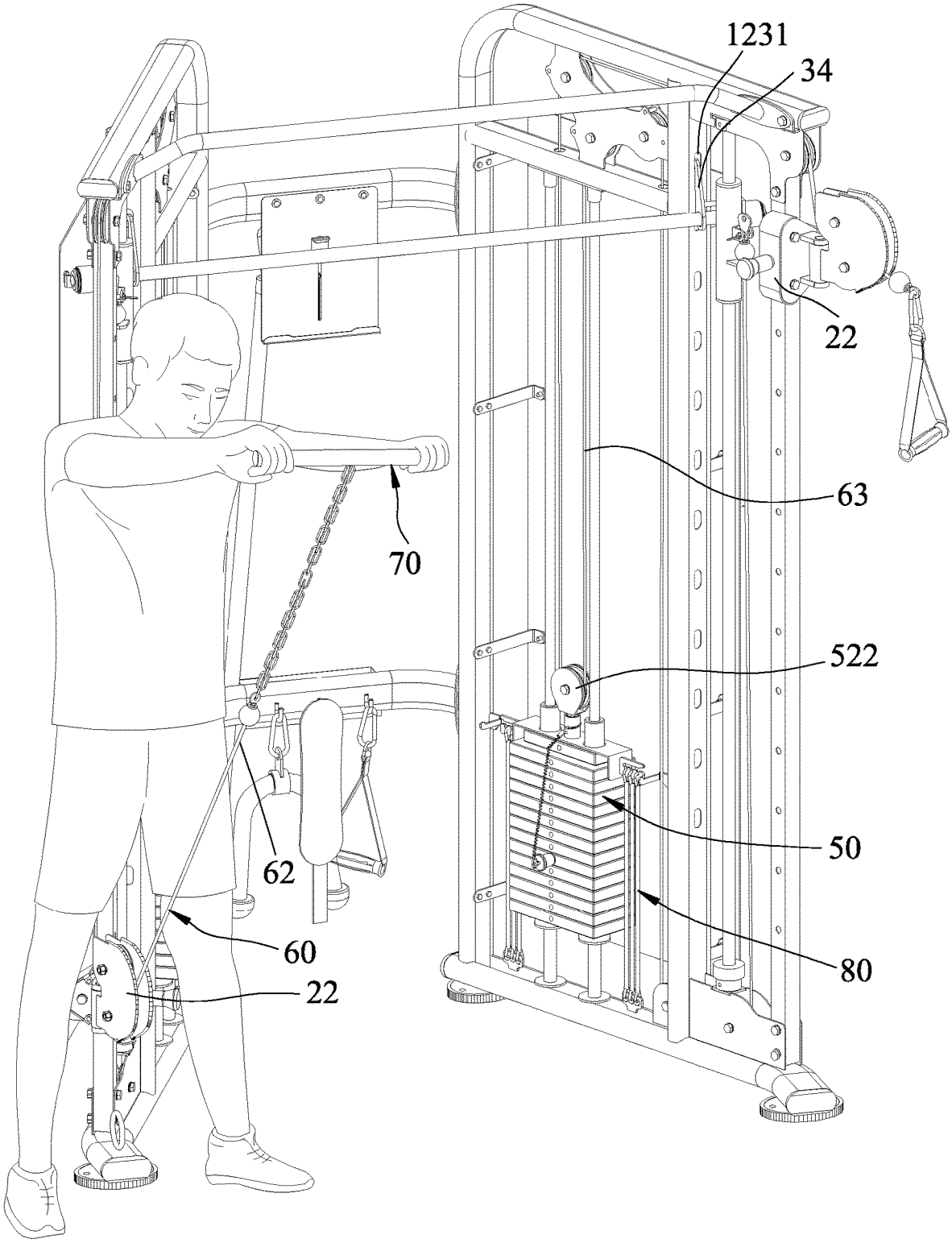
Figure 11:
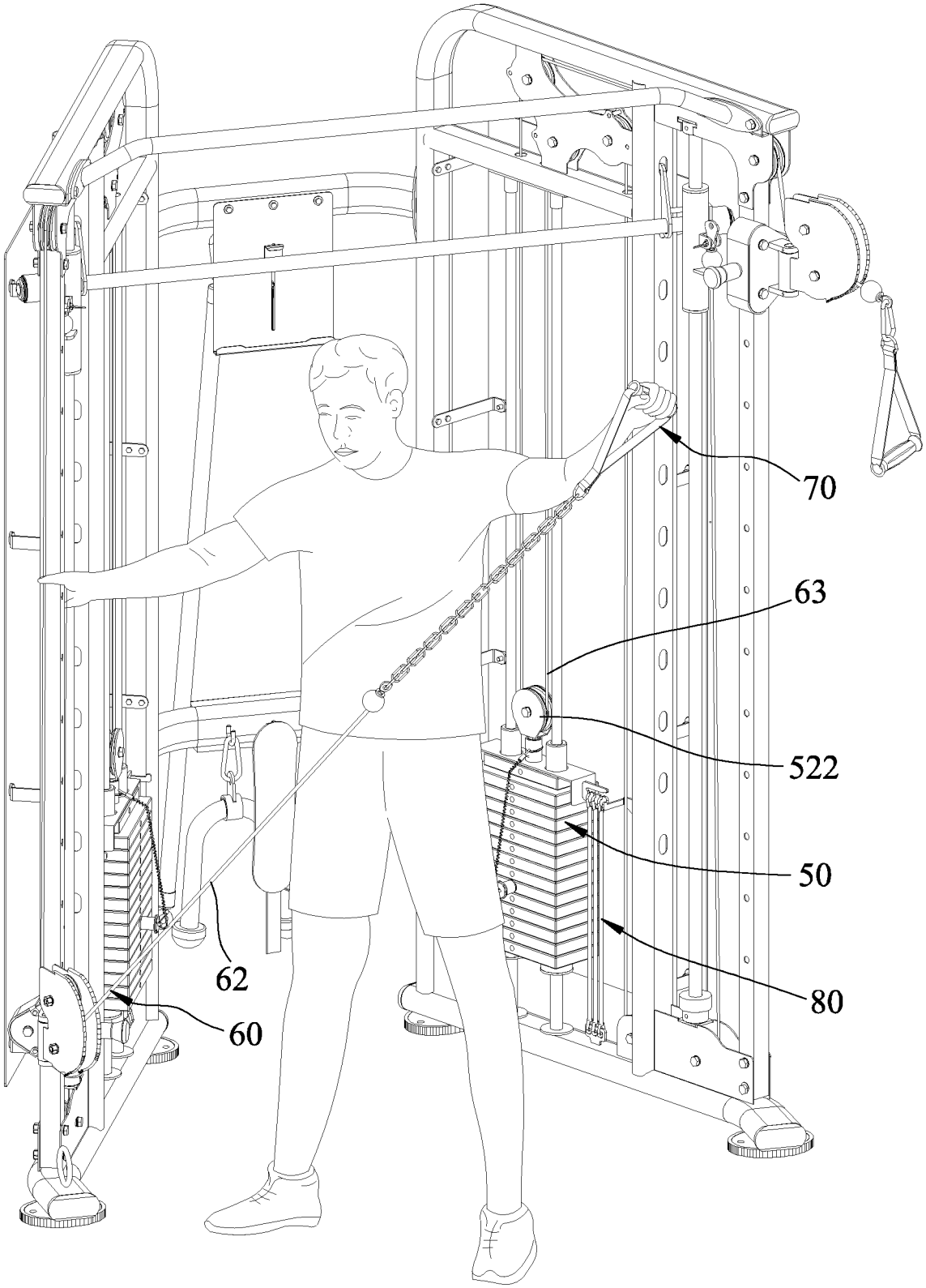
Figure 12:
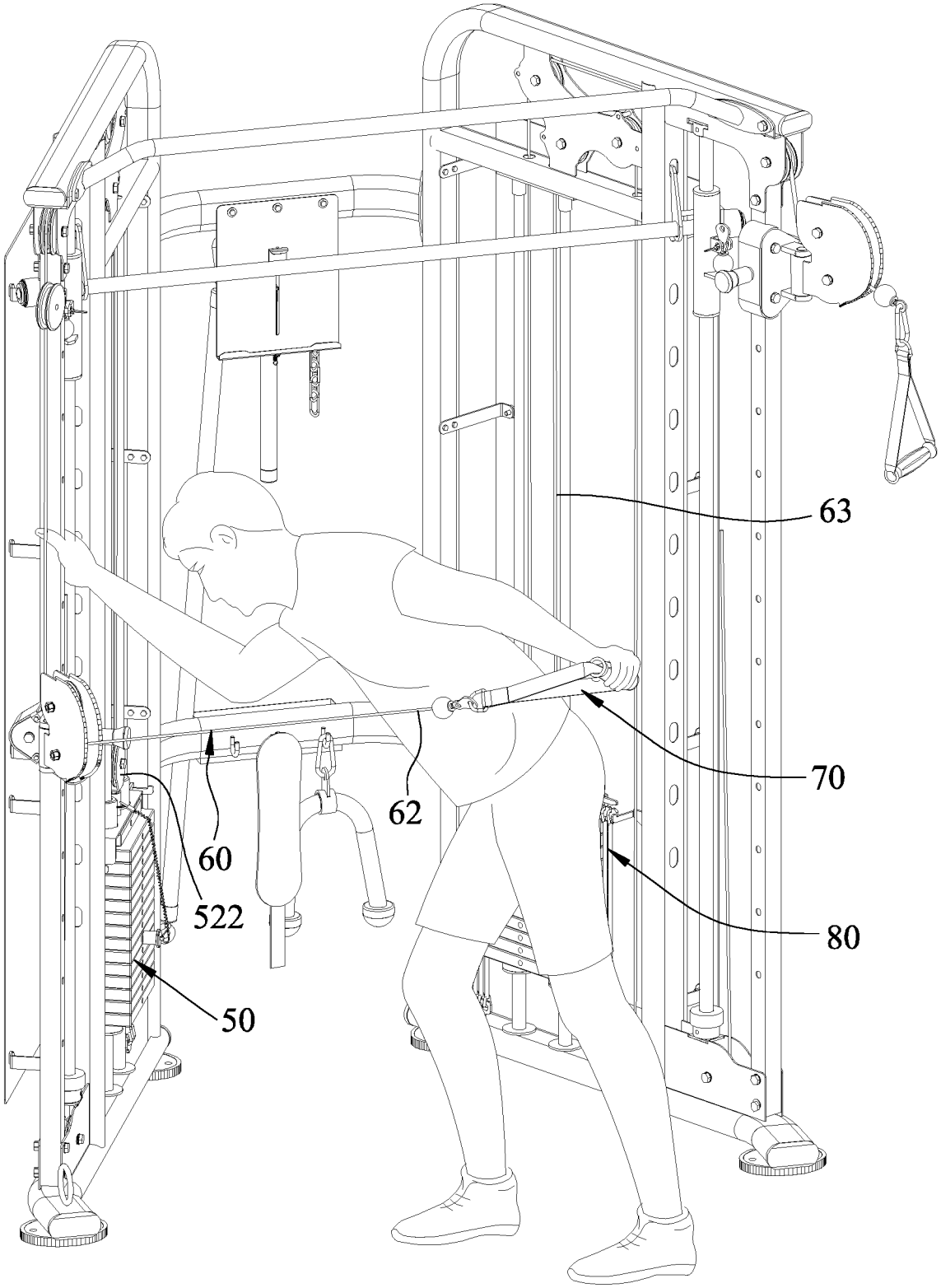
Figure 13:
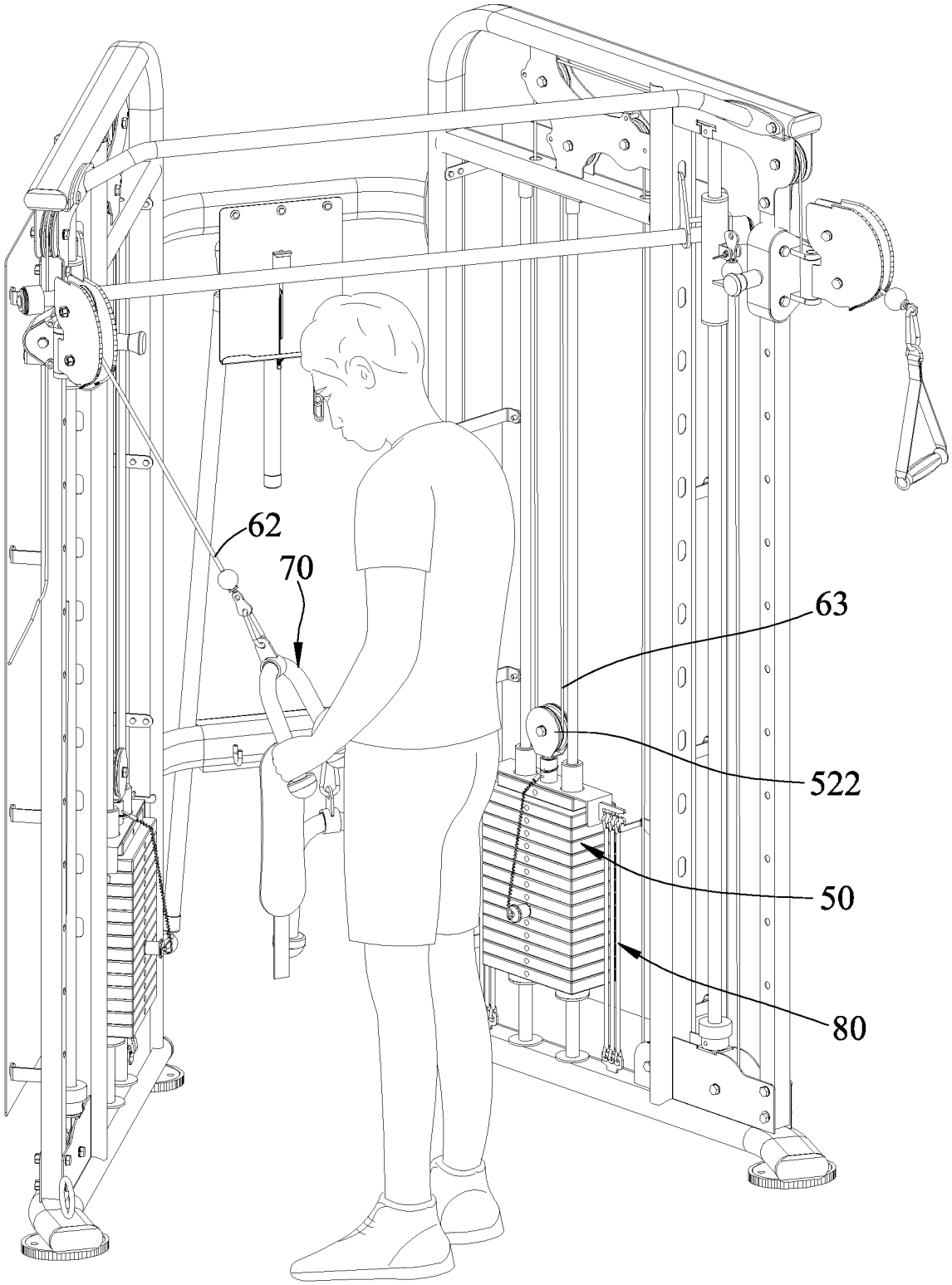
Figure 14:
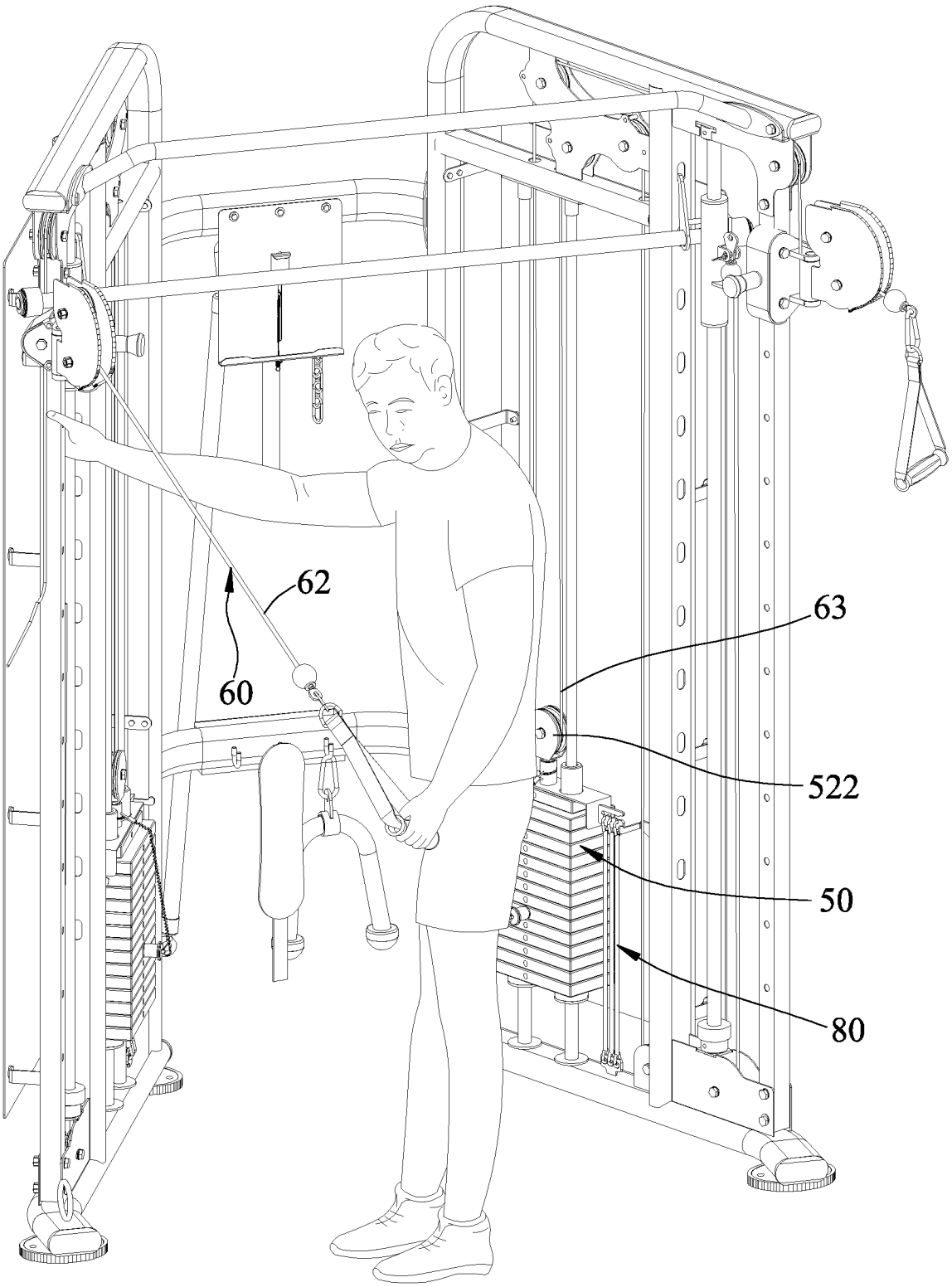
Figure 15:
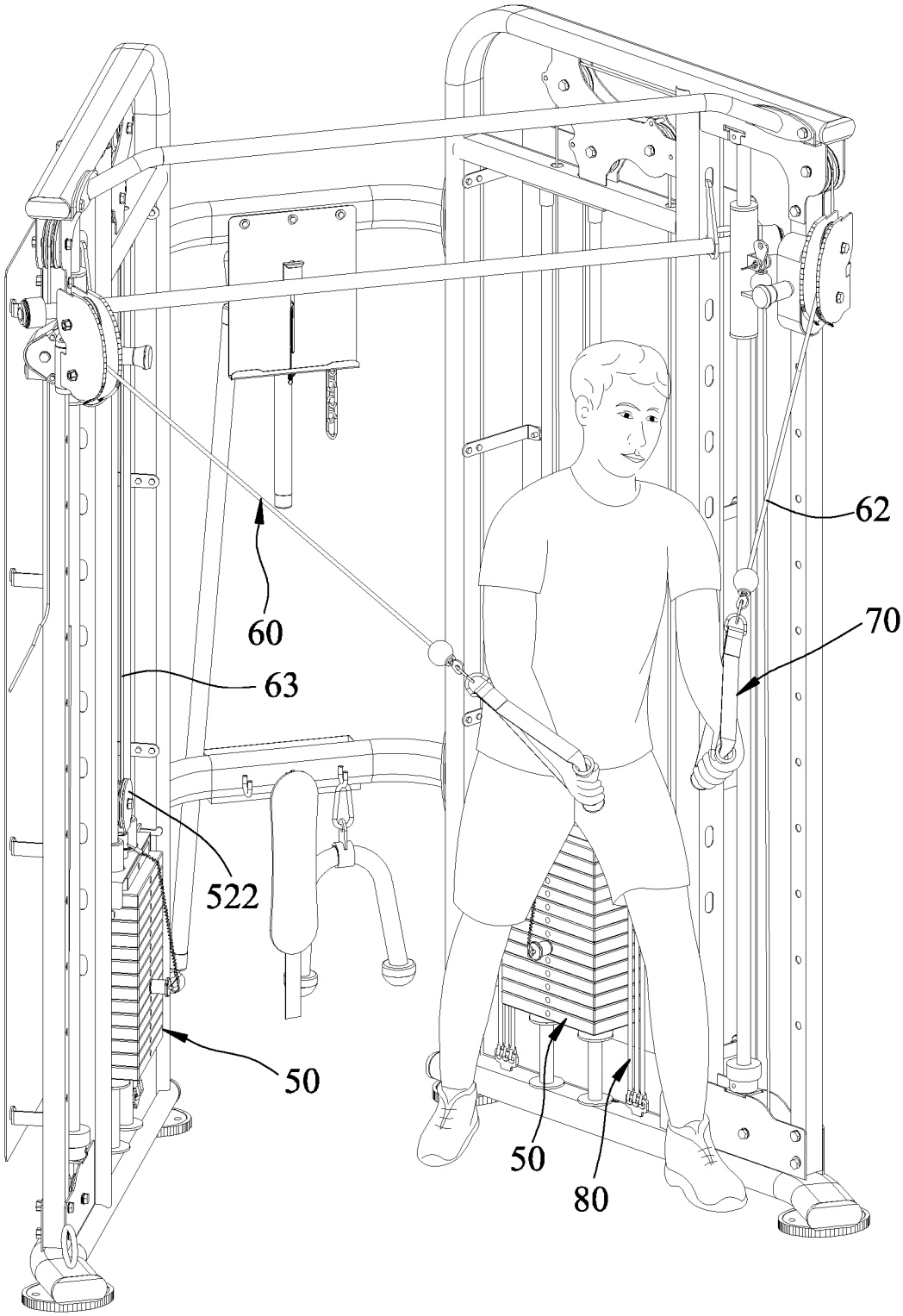
Figure 16:
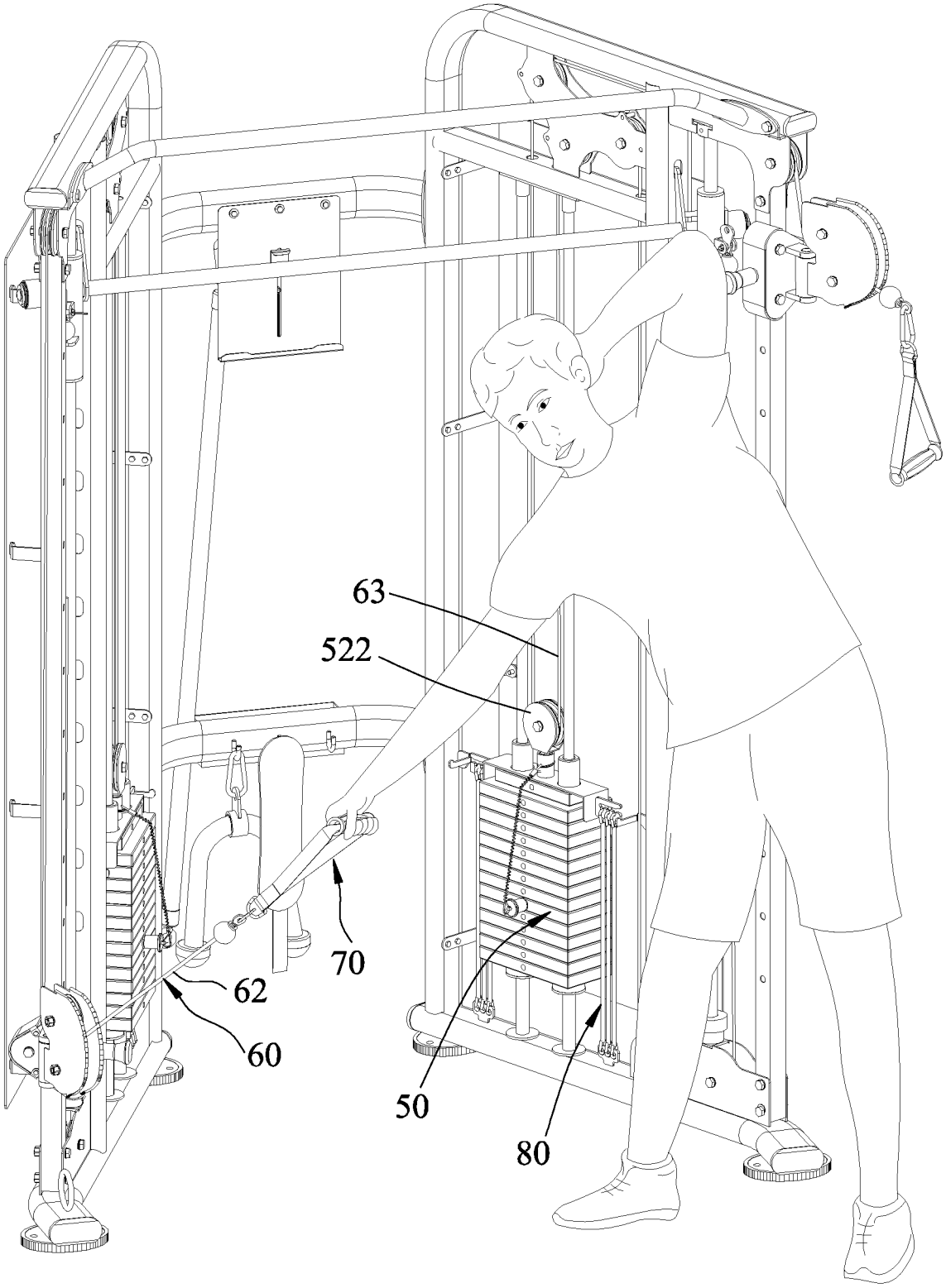
Figure 17:
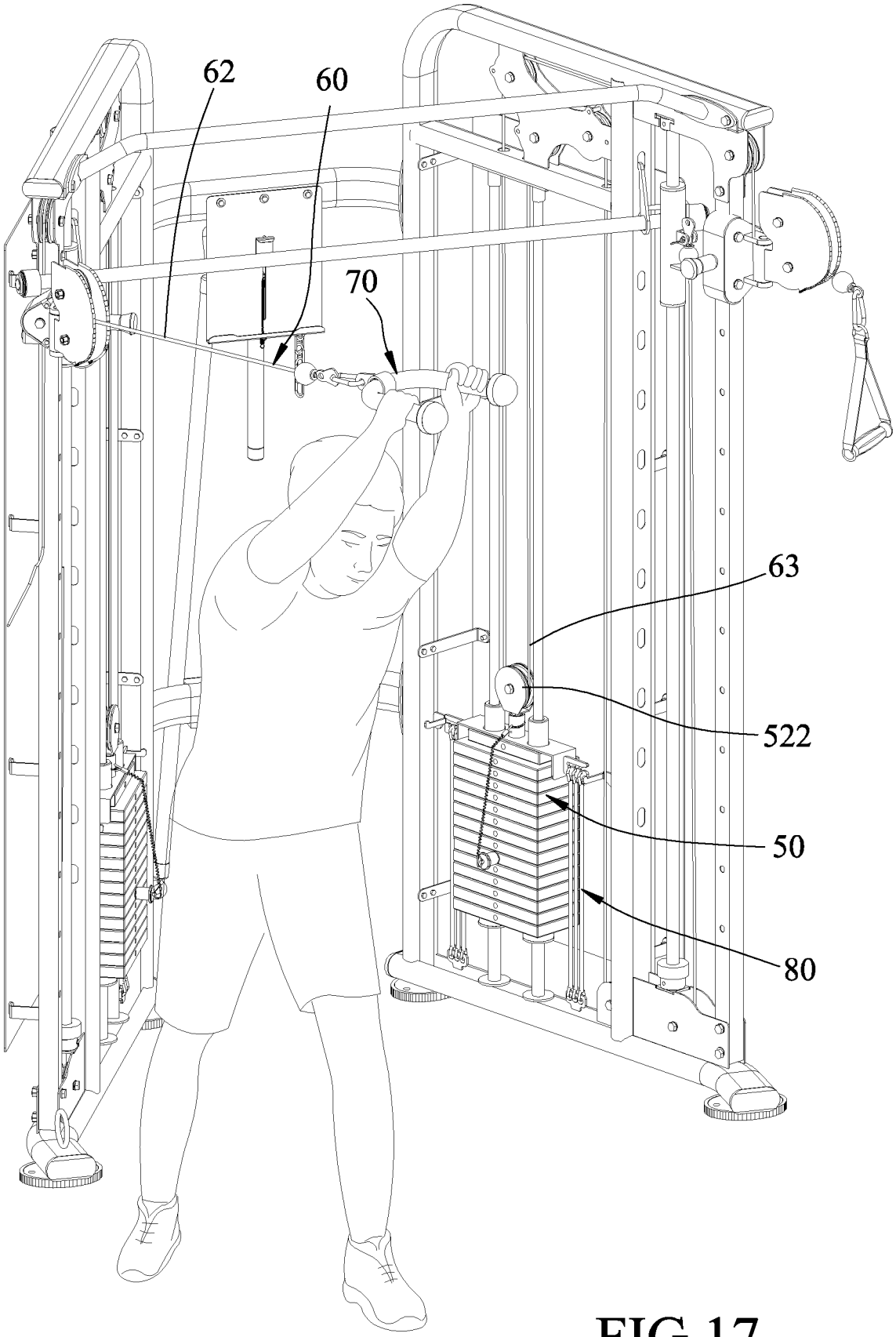
Figure 18:
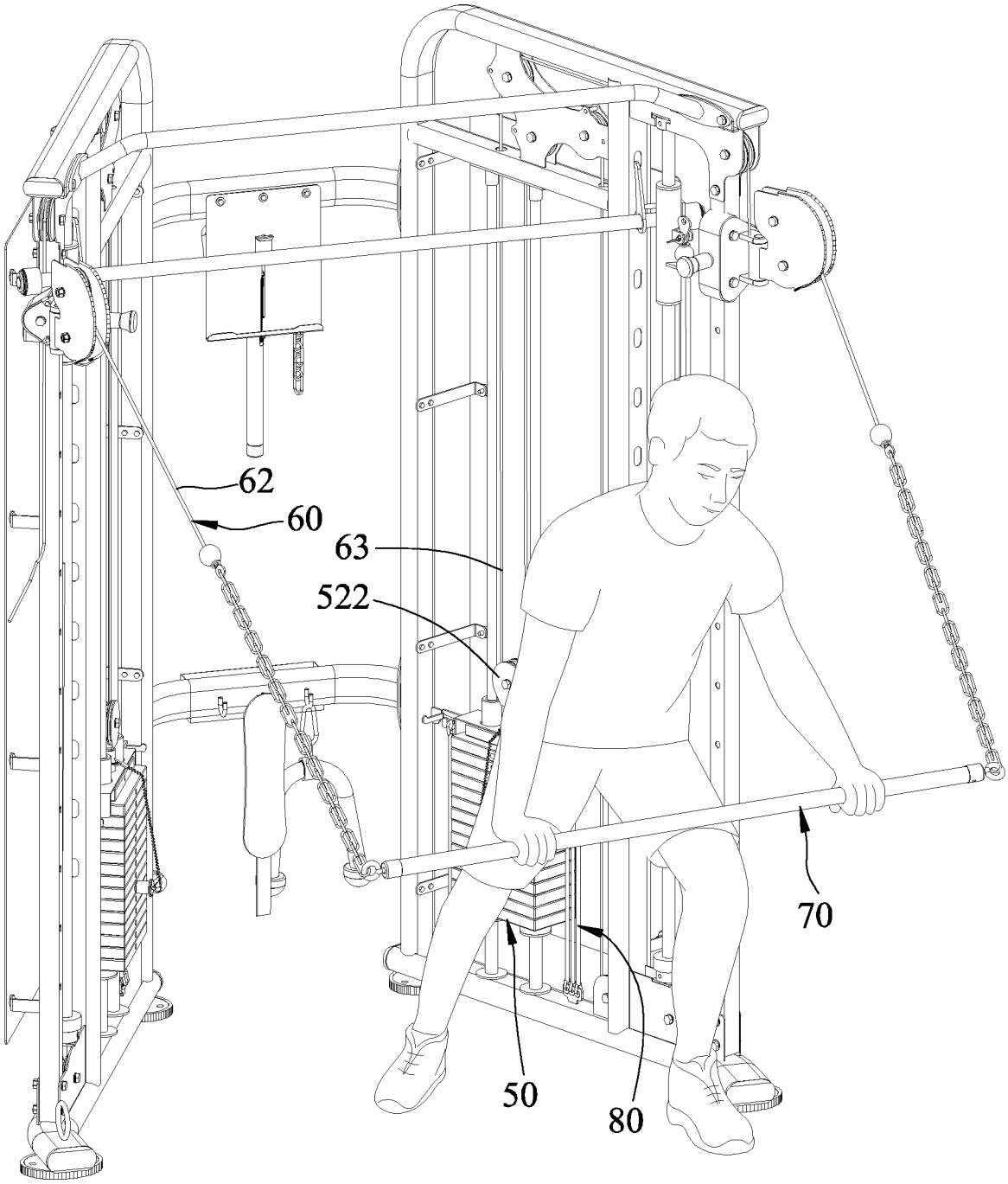

Referring to FIGS. 9 to 18, in combination with FIG. 5, when the comprehensive training device 100 of this disclosure is switched from the Smith machine exercise mode to the cable machine exercise mode, the first end 61 of the cable member 60 of each cable and pulley assembly 20 is positioned on the first fixing member 224 of the first sliding seat 22 of the corresponding cable and pulley assembly 20, each hook member 34 is hooked to a selected one of the hanging holes 1231, and the height of the first sliding seat 22 of each cable and pulley assembly 20 is adjusted by the user according to his requirement. In cooperation with the different handles 70 connected to the second end 62 of the cable member 60 of each cable and pulley assembly 20, the cable member 60 can be driven when the handle 70 is pulled, and with the middle section 63 of the cable member 63 of each cable and pulley assembly 20 looping around the counterweight pulley 522 of the corresponding counterweight unit 50 so as to move the same, and through the weight of each counterweight unit 50 and the elasticity of each tension rope unit 80, the user can perform a stand biceps curls exercise, as shown in FIG. 9, a front raise exercise, as shown in FIG. 10, a cable one-hand front laterals exercise, as shown in FIG. 11, a triceps extension exercise, as shown in FIG. 12, a triceps push down exercise, as shown in FIG. 13, a one-hand pull down exercise, as shown in FIG. 14, an incline pectoral fly exercise, as shown in FIG. 15, a side pull exercise, as shown in FIG. 16, a cable kickback exercise, as shown in FIG. 17, and a bar pull exercise, as shown in FIG. 18.

In summary, the effect of this disclosure resides in that, when the first and second ends 61, 62 of the cable member 60 of each cable and pulley assembly 20 are positioned on the first sliding seat 22 of the corresponding cable and pulley assembly 20, the cable machine exercises can be performed by the user; and, when the first end 61 of the cable member 60 of each cable and pulley assembly 20 is positioned on the corresponding second sliding seat 33, the Smith machine exercises can be performed by the user.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fast-switching comprehensive training device comprising:

a main frame including a middle portion, two side frame portions connected to opposite ends of said middle portion, two pairs of counterweight guide rods respectively disposed on said two side frame portions, and two pairs of cushion pads respectively disposed on bottom portions of said two pairs of said counterweight guide rods, each of said two side frame portions including a bottom rod, a top rod opposite to said bottom rod, and at least one vertical rod connected between said bottom rod and said top rod and spaced apart from and parallel to a corresponding one pair of said two pairs of counterweight guide rods, said at least one vertical rod having a plurality of hanging holes spaced apart from each other along a length thereof;

two cable and pulley assemblies symmetrically disposed on said two side frame portions, each of said two cable and pulley assemblies including an adjustment tube connected between said respective bottom rod and said respective top rod and spaced apart from and parallel to said respective at least one vertical rod, a first sliding seat slidably sleeved on said adjustment tube, an adjustment pin removably inserted into said first sliding seat, two spaced-apart first upper pulleys mounted on said respective top rod, two second upper pulleys disposed below said two spaced-apart first upper pulleys, two lower pulleys mounted on said respective bottom rod, and a cable member having a first end, a second end opposite to said first end, and an intermediate section connected between said first end and said second end, said adjustment tube having a plurality of height adjustment holes spaced apart from each other along a length thereof;

a barbell unit including two sliding guide rods respectively disposed on said two side frame portions, two second sliding seats sleeved slidably and respectively on said sliding guide rods, an exercise bar having two opposite ends connected fixedly and respectively to said two second sliding seats, and two hook members rotatably disposed on said exercise bar in proximity to said two opposite ends thereof, each of said two sliding guide rods being connected between said bottom rod and said top rod of a respective one of said two side frame portions, and being located between said respective at least one vertical rod and said respective adjustment tube, each of said two hook members being removably hooked to a selected one of said plurality of hanging holes in said at least one vertical rod of the respective one of said two side frame portions so as to position each of said two second sliding seats relative to said at least one vertical rod of the respective one of said two side frame portions and a corresponding one of said two sliding guide rods;

two counterweight units respectively disposed on said two side frame portions and respectively movable along said two pairs of counterweight guide rods, each of said counterweight units including a pulley bracket disposed on top thereof, and a counterweight pulley pivotally connected to said pulley bracket; and two tension rope units, each of said two tension rope units including a plurality of tension ropes;

wherein, when said respective adjustment pin is inserted into said respective first sliding seat and extends into a corresponding one of said plurality of height adjustment holes, said respective first sliding seat is fixed to said respective adjustment tube at a desired height;

wherein said respective first end of said respective cable member is movable between a first position, in which said respective first end of said respective cable member is positioned on said respective first sliding seat to place said fast-switching comprehensive training device in a first exercise mode, and a second position, in which said respective first end of said respective cable member is positioned on said respective second sliding seat to place said fast-switching comprehensive training device in a second exercise mode;

wherein said respective second end of said respective cable member is positioned on said respective first sliding seat opposite to said respective first end, and said respective intermediate section of said respective cable member is looped around said respective two lower pulleys, said respective second upper pulleys, said respective counterweight pulley and said first upper pulleys; and wherein each of said plurality of tension ropes has one end hooked to said respective bottom rod, and the other end removably hooked to a corresponding one of said two counterweight units.

2. The fast-switching comprehensive training device as claimed in claim 1, wherein:

each of said two side frame portions has at least one fixed plate disposed on said respective bottom rod;

each of said two counterweight units further includes at least one tension rope selection rack sleeved on the corresponding one pair of said two counterweight guide rods, and a selection rod inserted into said at least one tension rope selection rack and transverse to said respective bottom rod and said respective top rod;

said pulley brackets of each of said two counterweight units is disposed on top of said selection rod; and said one end of each of said tension ropes is hooked to said respective at least one fixed plate, and said other end of each of said tension ropes is removably hooked to said respective at least one tension rope selection rack.

3. The fast-switching comprehensive training device as claimed in claim 2, wherein each of said two counterweight units further includes a plurality of counterweights sleeved on said respective selection rod and the corresponding one pair of said two counterweight guide rods, and a selection pin removably inserted into a selected one of said plurality of counterweights and said respective selection rod.

4. The fast-switching comprehensive training device as claimed in claim 2, wherein each said at least one tension rope selection rack includes a plurality of tension rope selection racks sleeved on said respective selection rod and the corresponding one pair of said two counterweight guide rods, each of said two counterweight units further including a selection pin removably inserted into a selected one of said plurality of tension rope selection racks and said respective selection rod, said other end of each of said tension ropes being removably hooked to a corresponding one of said plurality of tension rope selection racks.

5. The fast-switching comprehensive training device as claimed in claim 1, wherein:

said first sliding seat of each of said cable and pulley assemblies includes a first sliding seat body slidably sleeved on said respective adjustment tube, a pivoting member connected to one side of said first sliding seat body that is distal to a corresponding one of said respective sliding guide rods, a pair of pulleys pivotally connected to said respective pivoting member for passing of said respective second end of said respective cable member therebetween, a U-shaped first fixing member connected to the other side of said respective first sliding seat body and opposite to said respective pivoting member, and a first positioning plate connected to said respective first sliding seat body and located below said respective first fixing member, said respective first fixing member having a pair of first pin holes, said respective first positioning plate having a first positioning hole defined by a C-shaped wall and tapering inwardly from a top surface of said respective first positioning plate; and each of said cable and pulley assemblies further includes a retaining unit, said retaining unit including a retaining ball connected to said respective first end of said respective cable member, a fastening piece fixed on top of said retaining ball, and an insert pin for positioning said respective first end of said respective cable member in one of said respective first position and said respective second position.

6. The fast-switching comprehensive training device as claimed in claim 5, wherein:

each of said second sliding seats includes a second sliding seat body sleeved slidably on a respective one of said two sliding guide rods, a U-shaped second fixing member fixed to one side of said respective second sliding seat body that is proximate to said respective adjustment tube, and a second positioning plate connected to said respective second sliding seat body and located below said respective second fixing member, said respective second fixing member having a pair of second pin holes, said respective second positioning plate having a second positioning hole defined by a C-shaped wall and tapering inwardly from a top surface of said second respective positioning plate;

said insert pin is removably inserted into said pair of first pin holes and said respective fastening piece to position said respective first end of said respective cable member at said first position, and is removably inserted into said respective pair of second pin holes and said respective fastening piece to position said respective first end of said respective cable member at said respective second position; and said respective retaining ball abuts against said respective first positioning plate when said respective first end of said respective cable member is at said respective first position, and abuts against said second positioning plate when said respective first end of said respective cable member is at said respective second position.

* * * * *